US008424581B2

(12) United States Patent
Brandes

(10) Patent No.: US 8,424,581 B2
(45) Date of Patent: Apr. 23, 2013

(54) AIR CONVEYOR AND APPARATUS FOR APPLYING TAB USING THE AIR CONVEYOR

(75) Inventor: Chris Brandes, Sebastian, FL (US)

(73) Assignee: Profold, Inc., Sebastian, FL (US)

( * ) Notice: Subject to any disclaimer, the term of this patent is extended or adjusted under 35 U.S.C. 154(b) by 797 days.

(21) Appl. No.: 12/581,914

(22) Filed: Oct. 20, 2009

(65) Prior Publication Data

US 2010/0115889 A1 May 13, 2010

Related U.S. Application Data

(60) Provisional application No. 61/113,291, filed on Nov. 11, 2008.

(51) Int. Cl.
*B65B 61/00* (2006.01)
*B65H 20/14* (2006.01)

(52) U.S. Cl.
USPC ..... 156/541; 226/97.1

(58) Field of Classification Search ..... 156/541; 53/415, 135.1; 226/97.1; *B65B 61/00; B65H 20/14*
See application file for complete search history.

(56) References Cited

U.S. PATENT DOCUMENTS

| | | | | |
|---|---|---|---|---|
| 3,181,916 | A | 5/1965 | Epstein | 302/29 |
| 4,047,372 | A * | 9/1977 | Horstmann et al. | 57/279 |
| 4,321,103 | A | 3/1982 | Lindstrom et al. | 156/351 |
| 4,542,842 | A * | 9/1985 | Reba | 225/2 |
| 4,632,321 | A * | 12/1986 | Danler | 241/62 |
| 4,676,859 | A * | 6/1987 | Cleary et al. | 156/361 |
| 4,915,547 | A | 4/1990 | Cahill et al. | 406/87 |
| 5,145,292 | A * | 9/1992 | Bulso et al. | 406/88 |
| 5,156,312 | A * | 10/1992 | Kurie | 242/615.11 |
| 5,370,289 | A * | 12/1994 | Helms | 242/615.11 |
| 5,393,366 | A | 2/1995 | Bell | 156/443 |
| 5,896,977 | A * | 4/1999 | Ouellette | 198/415 |
| 5,951,006 | A | 9/1999 | Biegelsen et al. | 271/195 |
| 6,024,518 | A | 2/2000 | Ouellette | 406/88 |
| 6,143,105 | A | 11/2000 | Nash et al. | 156/64 |
| 6,196,392 | B1 | 3/2001 | Lopez et al. | 209/540 |
| 6,212,984 | B1 | 4/2001 | Kane | 83/100 |
| 6,328,839 | B1 | 12/2001 | Lopez et al. | 156/212 |
| 6,383,321 | B2 | 5/2002 | Kubert et al. | 156/64 |
| 6,932,451 | B2 | 8/2005 | Annacone | 347/2 |
| 7,207,794 | B2 * | 4/2007 | Pawloski et al. | 425/500 |
| 2008/0229712 | A1 * | 9/2008 | Dominguez et al. | 53/415 |

FOREIGN PATENT DOCUMENTS

| | | |
|---|---|---|
| DE | 3131125 | 2/1983 |

* cited by examiner

*Primary Examiner* — Philip Tucker
*Assistant Examiner* — Shawn F Hogan
(74) *Attorney, Agent, or Firm* — Allen, Dyer, Doppelt, Milbrath & Gilchrist, P.A.

(57) ABSTRACT

An air conveyor is positioned on a tabbing machine and includes a housing having an air chamber and a web entry and web exit and air port communicating with the air chamber. An air nozzle assembly is positioned within the air chamber and includes upper and lower nozzle plates that extend across the air chamber and spaced from each other to form a web delivery channel that is aligned with the web entry and web exit. Each of the nozzle plates includes a plurality of air nozzles extending through the nozzle plate and configured to pass pressurized air from the air chamber into the web delivery channel such that a web of material entering the web entry is drawn, for example, by venturi pressure, from the web entry through the web delivery channel and out the web exit.

10 Claims, 7 Drawing Sheets

AIR CONVEYOR AND APPARATUS FOR APPLYING TAB USING THE AIR CONVEYOR

RELATED APPLICATION

This application is based upon prior filed provisional application Ser. No. 61/113,291 filed Nov. 11, 2008.

FIELD OF THE INVENTION

This invention relates to air conveyors, and more particularly, this invention relates to an air conveyor used with a tabbing machine.

BACKGROUND OF THE INVENTION

Commonly assigned U.S. Pat. Nos. 6,383,321; 6,196,392; and 5,393,366, the disclosures which are hereby incorporated by reference in their entirety, disclose tabbing machines that apply a tab onto an article from a web of material having labels or tabs releasably secured on the web. In these tabbing machines, a tab (or label as they are sometimes referred) is dispensed onto an article such as a flat, planar article (e.g., an envelope) using apparatus that includes a tabber housing and a conveyor supported by the tabber housing and configured to advance the article to be tabbed along a predetermined path of travel. A tab dispenser is supported by the tabber housing and positioned above the path of travel and configured to dispense a tab from the web of material onto the article as it passes under the tab dispenser. The web of material can be formed such as a release paper that releasably secures a tab thereon. The web of material passes around a roller or sharp member and the tab or label is stripped from the web of material (e.g., release paper) in one non-limiting example.

In some prior art tabbing machines, after tabs have been released from the web of material and applied to articles, the web is taken up by a rewind roll mounted on the tabbing machine, which must be periodically changed after the rewind roll is filled with the scrap web material. The operator typically stops the tabbing machine, replaces the rewind roll with a new rewind roll, threads the leading edge of the web of material, e.g., release paper onto the new rewind roll, and starts the process again. This process is repeated as long as the tabbing machine is operating at a production run and new rewind rolls have to be inserted because older remind rolls are filled with scrap web material.

SUMMARY OF THE INVENTION

An air conveyor, in accordance with non-limiting examples, is provided on a tabbing machine for conveying scrap web material after tabbing. The air conveyor includes a housing having an air chamber and a web entry and web exit. An air port communicates with the air chamber. A nozzle assembly is positioned within the air chamber and includes upper and lower nozzle plates that extend across the air chamber and are spaced from each other to form a web delivery channel that is aligned with the web entry and web exit. In one aspect, the web delivery channel is a planar configured channel that provides a laminar air flow. Each of the nozzle plates include a plurality of air nozzles extending through the nozzle plate and configured to pass pressurized air from the air chamber into the web delivery channel such that a web of material entering the web entry is drawn such as by venturi pressure from the web entry through the web delivery channel and out the web exit.

In one aspect, the air conveyor is supported by a tabbing machine, which includes a tabber housing and a conveyor supported by the tabber housing and configured to advance the article to be tabbed along a predetermined path of travel. In one aspect, a tab dispenser is supported by the tabber housing and positioned above the path of travel and configured to dispense a tab from the web of material containing the tabs and onto the article as it passes under the tab dispenser. The air conveyor is supported by the tabber housing and configured to withdraw the web of material after tabbing.

In yet another aspect, angled air nozzles extend through the nozzle plate in a direction from the web entry towards the web exit. Each air nozzle is angled from about 5 degrees to about 25 degrees relative to the flat, planar inner and outer surface of each nozzle plate in another non-limiting example. In yet still another non-limiting example, each air nozzle has a diameter of between about 0.020 to about 0.040 inches. A counterbore extends at least partially through each air nozzle in another non-limiting example.

In yet another example, each nozzle plate has at least one air slot configured to allow pressurized air to pass through the nozzle assembly and pressurize the air chamber on both sides of the nozzle assembly. A nozzle gap gasket is positioned between each nozzle plate inward of the at least one air slot in another example and configured to seal the nozzle assembly and prevent pressurized air within the air chamber from passing edgewise between the nozzle plates and into the web delivery channel. The pressurized air in one aspect is between about 5 and about 25 pounds per square inch as it is passed into the air chamber through the air port.

In yet another aspect, a venturi gasket is positioned along both nozzle plates at each of the web entry and web exit and has a web opening dimensioned to allow a web of material of predetermined size to pass through the opening. Typically, the opening is substantially rectangular configured to allow a web of material such as a flat film of material to pass therein. For example, with a planar web of material such as a plastic web of film material, the opening is typically formed as a rectangular slot of narrow dimension, for example, about 0.125 inches in height and of a width to allow a four or five inch wide web to pass therein. An air delivery tube is mounted to the housing at the air port through which pressurized air is delivered. A clamp and air mount are secured onto the air delivery tube and adapted to attach the air delivery tube onto a tab applying apparatus such as a tabbing machine.

A method aspect is also set forth.

BRIEF DESCRIPTION OF THE DRAWINGS

Other objects, features and advantages of the present invention will become apparent from the detailed description of the invention which follows, when considered in light of the accompanying drawings in which.

DETAILED DESCRIPTION OF THE PREFERRED EMBODIMENTS

The present invention will now be described more fully hereinafter with reference to the accompanying drawings, in which preferred embodiments of the invention are shown. This invention may, however, be embodied in many different forms and should not be construed as limited to the embodiments set forth herein. Rather, these embodiments are provided so that this disclosure will be thorough and complete, and will fully convey the scope of the invention to those skilled in the art. Like numbers refer to like elements throughout.

Figure 1:
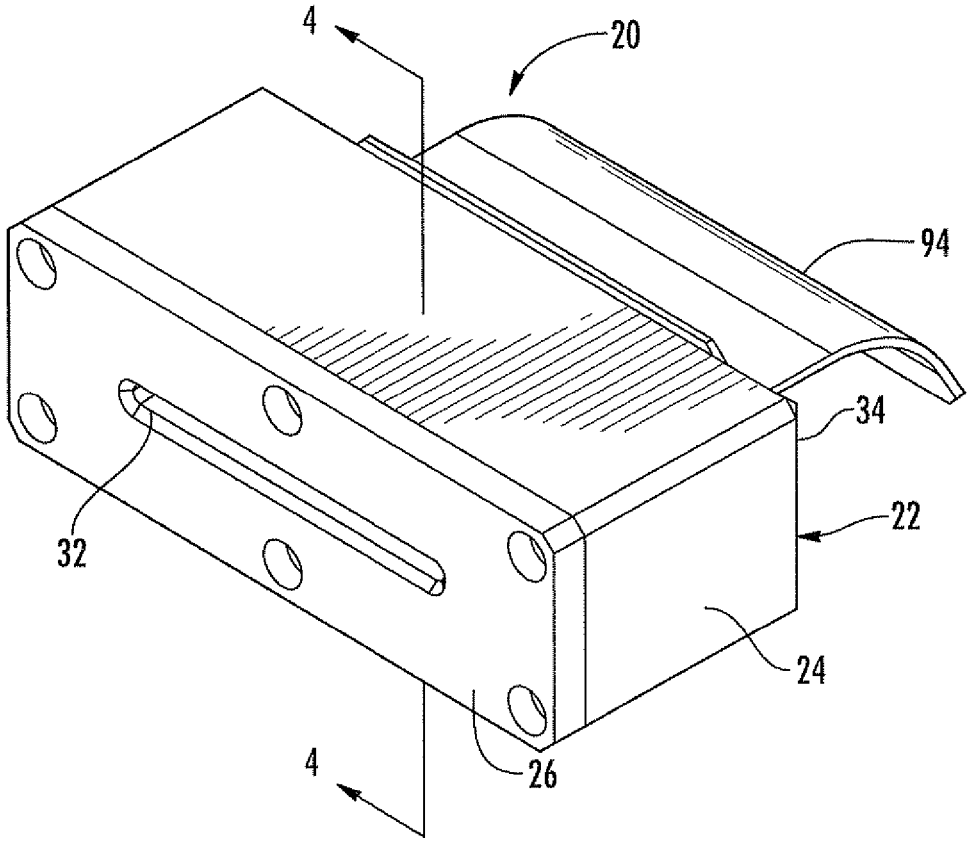
FIG. 1 is a perspective view of an air conveyor that can be used in accordance with a non-limiting example.
Figure 11:
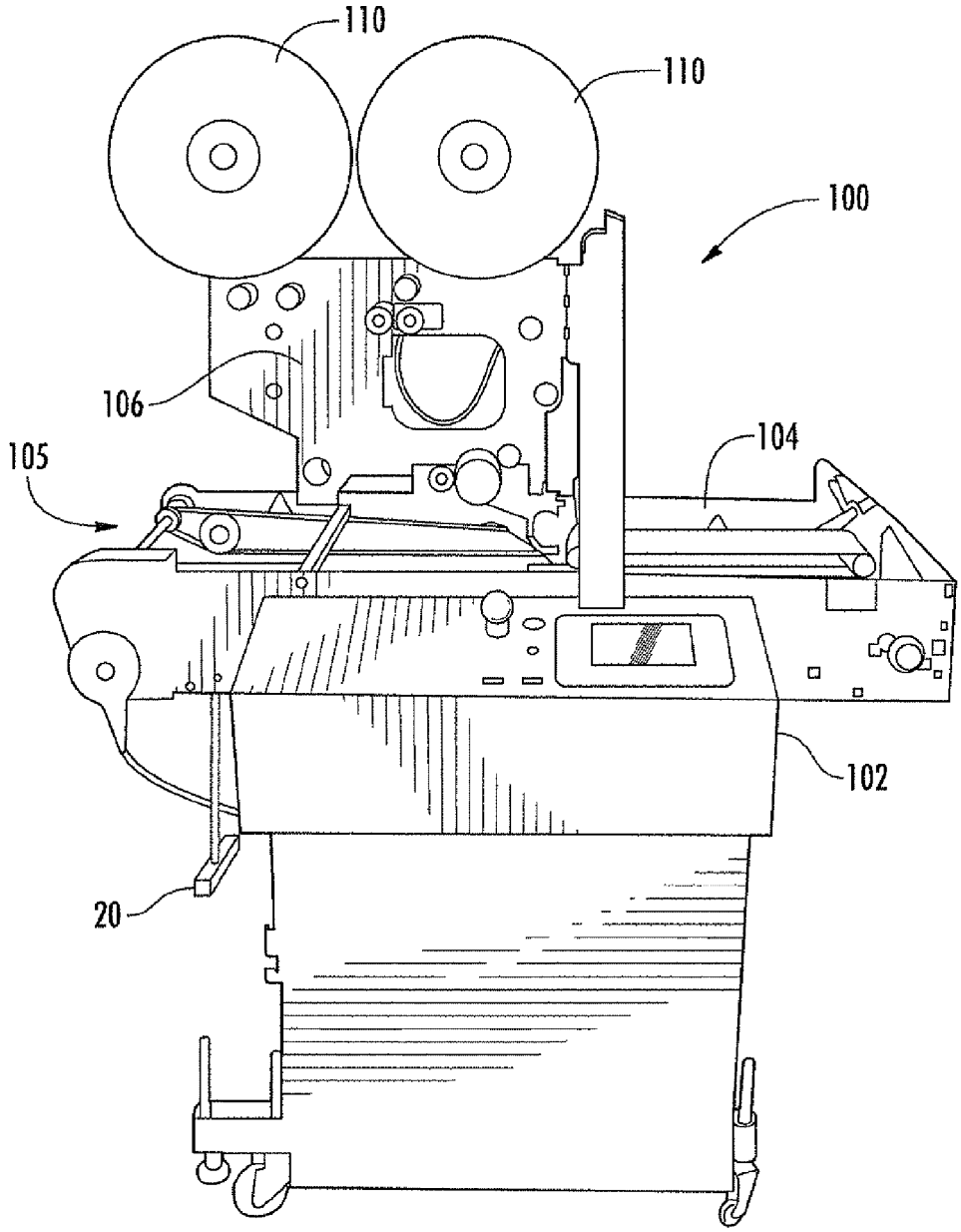
FIG. 11 is a front elevation view of a tabbing machine that incorporates the air conveyor in accordance with a non-limiting example and showing the air delivery tube mounted to the housing at the air port through which pressurized air is delivered such that the web of material after tabbing enters the web entry and is drawn from the web entry through the web delivery channel and out of the web exit for discharge.

FIG. 1 is an isometric view of the air conveyor 20 in accordance with a non-limiting example that can be used with the tabbing machine 100 such as shown in FIG. 11, where the air conveyor 20 off-loads a scrap web of material after tabbing and the tabs (also called labels) on the web of material have been released and applied onto an article, such as a flat or planar article, e.g., an envelope.

Figure 2:
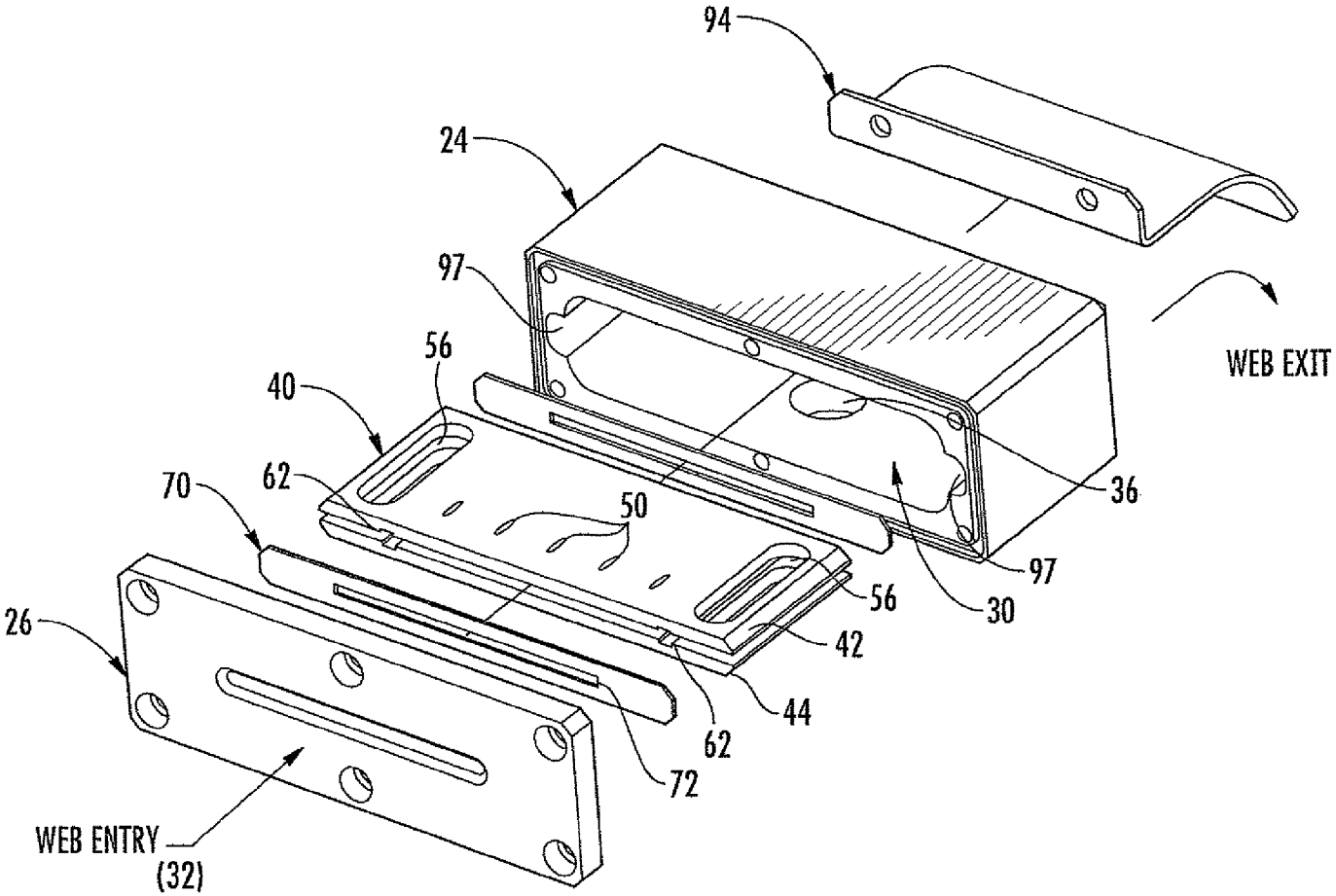
FIG. 2 is an exploded isometric view of the air conveyor shown in FIG. 1 in accordance with a non-limiting example.

FIG. 2 is an exploded isometric view of the air conveyor 20 showing greater details, including a housing 22 formed by a primary, rectangular configured housing member 24 and secured front cover plate 26 and having an air chamber 30 and a web entry 32 (within the front cover plate) and web exit 34 and air port 36 communicating with the air chamber 30. The housing member is rectangular configured in this aspect with rear opposing side and opposing top and bottom. The front is open to receive the front cover plate. Standard fasteners such as bolts 31 can be used to secure the front cover plate 26 to the housing member 24. Further details of these components are shown, for example, in the sectional view of FIG. 4.

Figure 4:
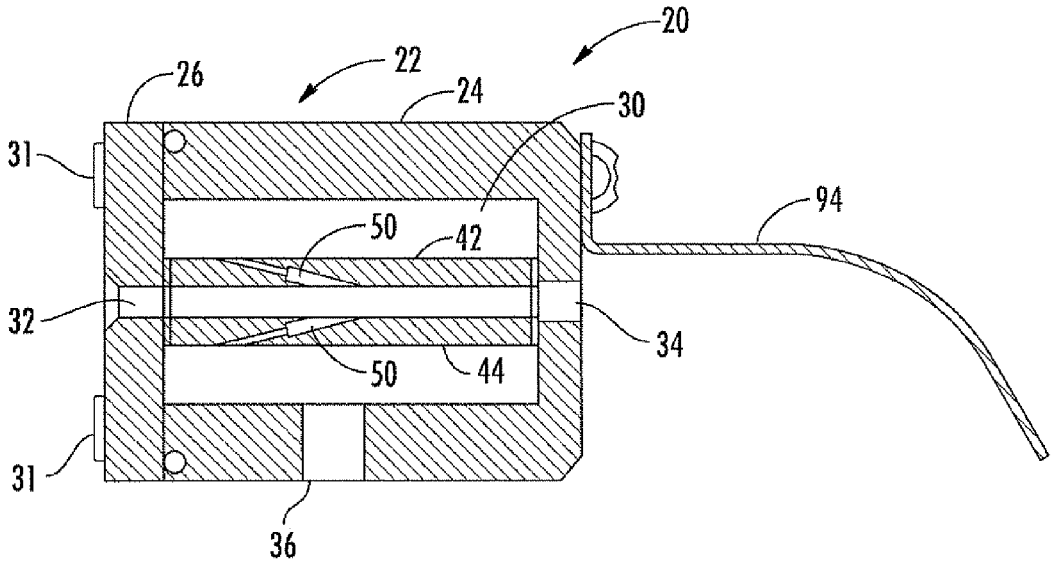
FIG. 4 is a sectional view taken along line 4-4 of FIG. 1 and showing the air nozzles positioned in the nozzle plates of the nozzle assembly in accordance with a non-limiting example.

A nozzle assembly 40 is positioned within the air chamber 30 and extends substantially medially across the air chamber from one side to the other opposing side and includes upper and lower nozzle plates 42,44 that extend across the air chamber 30 and are spaced from each other to form a web delivery channel 48 that is aligned with the web entry 32 and web exit 34 such as shown in FIG. 4. In one example, the nozzle plates are spaced apart about 0.125 inches to form a laminar web delivery channel between the upper and lower nozzle plates that is about four to about five inches wide in this non-limiting example. The width can be designed for specific web widths.

Figure 10:
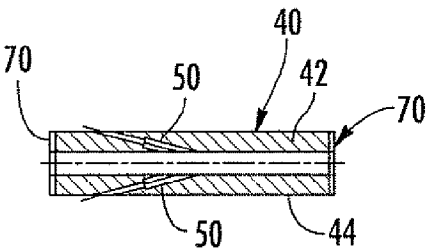
FIG. 10 is a sectional view taken along line 10-10 of FIG. 9 and showing the angle of the respective air nozzles within each of the upper and lower nozzle plates relative to the opposing planar surfaces of each nozzle plate.
Figure 7:
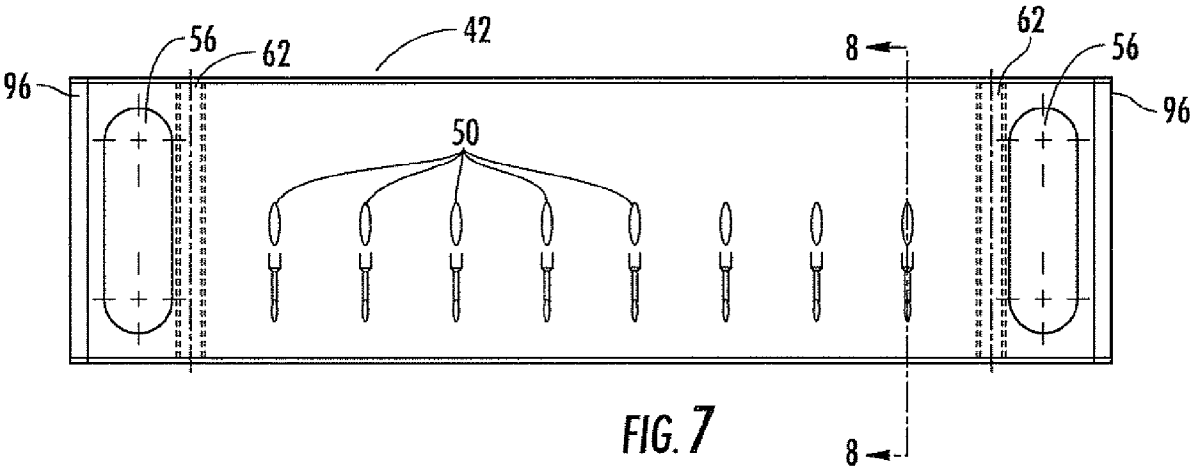
FIG. 7 is a top plan view of the nozzle plate shown in FIG. 6 in accordance with a non-limiting example.
Figure 9:
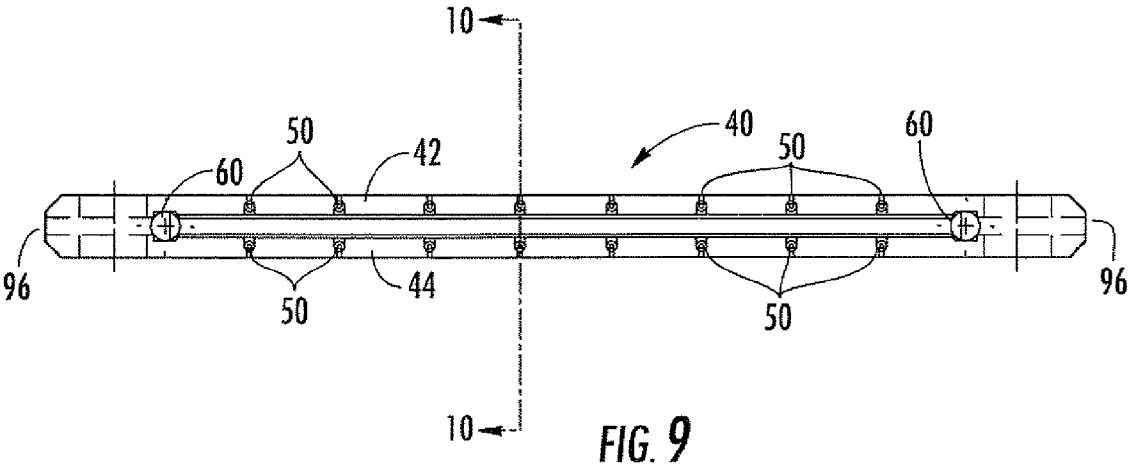
FIG. 9 is a side elevation view of the nozzle assembly in its assembled form that will be secured within the housing shown in FIG. 2.

Each of the nozzle plates 42,44 includes a plurality of air nozzles 50 as shown in greater detail in FIGS. 7, 9 and 10 that extend through the nozzle plates from an outer planar surface to an inner planar surface that forms the interior of the web delivery channel. These air nozzles are configured to pass pressurized air from the air chamber 30 into the web delivery channel 48 such that a web of material entering the web entry is drawn, for example, by venturi pressure, from the web entry 32 through the web delivery channel and out the web exit 34. Venturi effect is the term used because the restriction created by the web delivery channel and flow of air from the air nozzles creates the vacuum draw to draw the web material through the air conveyor. As illustrated, each nozzle plate 42,44 is a planar configured member that is substantially rectangular configured and includes opposing planar surfaces as flat surfaces that form the outer and inner planar surfaces of each nozzle plate when upper and lower nozzle plates are together and form the nozzle assembly 40.

Figure 8:
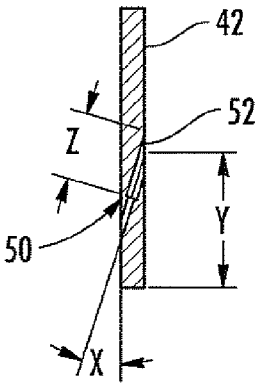
FIG. 8 is a sectional view taken along line 8-8 of FIG. 7 and showing the angle of the air nozzle within the nozzle plate relative to the opposing planar surfaces of the nozzle plate.

As shown in greater detail in FIGS. 4, 6, 7, 8 and 10, the air nozzles 50 are angled relative to the opposing planar surfaces of the nozzle plates and extend through the nozzle plates in a direction from the web entry 32 towards the web exit 34. Each air nozzle 50 in one aspect is angled from about 5 degrees to about 25 degrees relative to the opposing planar surfaces of each nozzle plate. As shown in FIG. 8, a preferred angle (x) of the air nozzle is about 15 degrees. Each air nozzle 50 has a diameter between about 0.020 to about 0.040 inches in a non-limiting example, and in one preferred aspect, is about 0.028 inches in diameter. Each air nozzle 50 further includes a counterbore 52 extending at least partially therethrough as best shown in FIG. 8. In one aspect, the dimension Y (FIG. 8) is 0.74 or 0.75 inches and dimension Z is about 0.37 inches in a non-limiting example. Each counterbore is typically about 0.060 inches in diameter by about 0.37 DP in one non-limiting example as shown by the dimension Z in FIG. 8.

Figure 5:
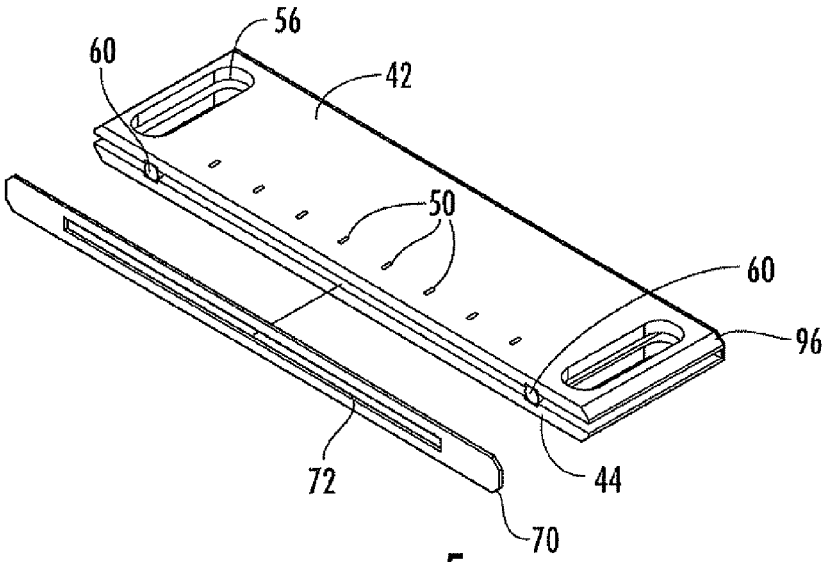
FIG. 5 is an exploded isometric view showing the upper and lower nozzle plates and a nozzle gap gasket positioned between each nozzle plate on either end to seal the web delivery channel at the side edges and a venturi gasket in accordance with a non-limiting example.
Figure 6:
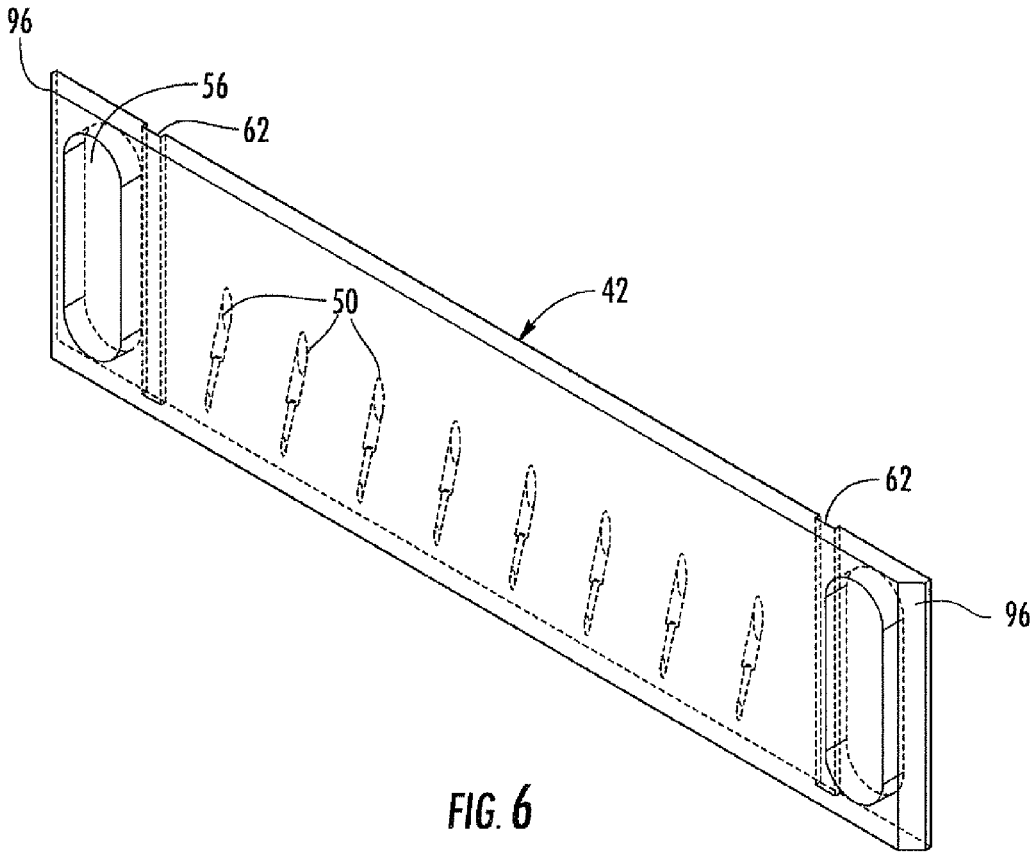
FIG. 6 is an isometric view of a nozzle plate showing by hidden lines the air nozzles extending through the nozzle plate and each air nozzle including a counterbore and also showing the air slots positioned on opposing sides of the nozzle plate.

As shown in FIG. 2 and in the other drawing FIGS. 5, 6 and 7, each nozzle plate 42,44 is substantially rectangular configured and substantially planar configured with the opposing, planar surfaces, and includes at least one air slot 56 near the side edge and configured to allow pressurized air to pass through the nozzle assembly 40 and pressurize the air chamber 30 on both sides of the nozzle assembly (as formed by the nozzle plates 42,44). In a preferred aspect, each nozzle plate 42,44 includes an air slot 56 at either side edge of the respective nozzle plate that is aligned with a respective other air slot when the nozzle plates are secured together such as shown in FIG. 9 and form the nozzle assembly to allow pressurized air to pass therethrough such that an equal air pressurization occurs throughout the air chamber even though the air port is located on one side of the nozzle assembly as shown best in FIG. 4.

A nozzle gap gasket 60 as shown in FIGS. 5 and 9 is positioned between each of the nozzle plates 42,44 within a gasket receiving slot 62 and positioned inward of the at least one air slot 56. This gasket 60 is configured to seal the nozzle assembly 40 at its edges and prevent pressurized air within the air chamber 30 from passing edgewise between the nozzle plates and into the web delivery channel 48. The nozzle gap gasket 60 is typically a cylindrical member as shown in FIG. 5 and positioned within the gasket receiving slots 62 formed on the interior surface of each nozzle plate. The gasket 60 forms a pneumatic, air-tight seal and prevents pressurized air from passing edgewise between the nozzle plates.

In one aspect, pressurized air between about 5 and 25 pounds per square inch is passed into the air chamber 30 through the air port 36 such that the web of material entering the web entry is drawn, for example, by venturi pressure, from the web entry 32 through the web delivery channel 48 and out of the web exit 34. In one aspect, about 12 to about 15 pounds per square inch of pressurized air has been found adequate to operate the described air conveyor 20. In yet another aspect, a venturi gasket 70 is positioned along both upper and lower nozzle plates 42,44 at their front and rear edges when both nozzle plates are secured together and positioned at each of the web entry 32 and web exit 34. This gasket 70 is longitudinal and in the illustrated aspect includes a rectangular opening 72 dimensioned to pass therethrough a web of material of predetermined size used by the tabbing machine, for example. As shown in FIG. 2, each venturi gasket 70 has a configuration similar to the edge configuration of the nozzle assembly 40 as formed by the combined and secured together upper and lower nozzle plates and includes the rectangular configured opening 72 through which a planar configured web of material passes in this non-limiting example.

Figure 3:
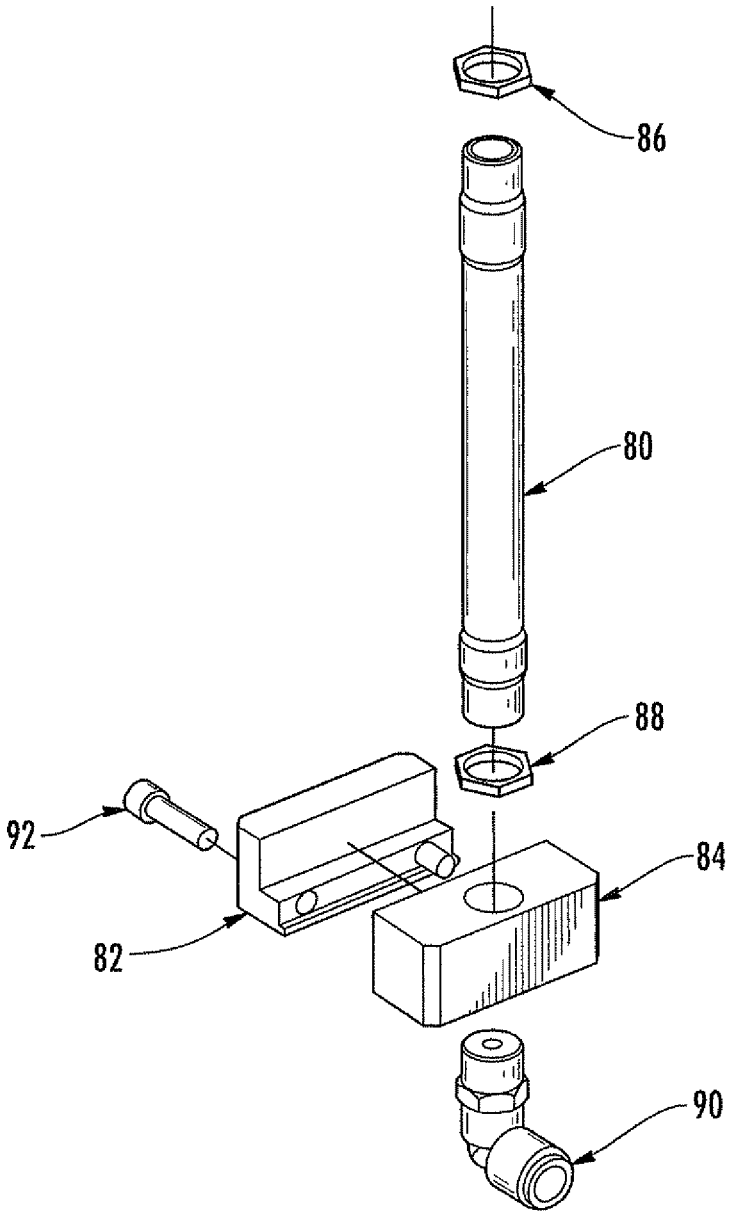
FIG. 3 is an exploded isometric view of an air delivery tube that can be mounted to the housing of the air conveyor at the air port through which pressurized air is delivered and showing a clamp and arm mount that can be used to attach the air delivery tube onto a tabbing machine or other similar machine that requires an air conveyor.

As shown in FIG. 3, an air delivery tube 80 can be mounted to the housing 22 at the air port 30 through which pressurized air is delivered. A clamp 82 and arm mount 84 can be secured onto the air delivery tube 80 and adapted to attach the air delivery tube onto a tabbing machine 100. For example, FIG. 11 shows the air delivery tube 80 secured to the air conveyor 20 and mounted to the tabbing machine 100 using the clamp and arm mount (not shown). Other components are illustrated, for example, the nut 86 for securing the end of the arm tube into the air port and a nut 88 for securing the other end of the air tube onto the arm mount 84. An elbow tube 90 allows different air line connectors for supplying compressed air. The clamp 82 is adjusted for mounting via the adjustment screw 92.

FIGS. 1 and 2 show a deflector 94 mounted to the housing 22 and used to deflect the web of material as it is discharged from the web exit 34. The nozzle assembly 40 is configured when the nozzle plates 42,44 are secured together to have an edge bevel or chamfer 96 at either end (FIG. 9) to permit the nozzle assembly to be received within the housing member 24 through formed housing slots 97 that act as slotted receivers to receive the chamfered edge of the nozzle assembly and position accurately the nozzle assembly substantially medially across the housing member within the air chamber. In this embodiment, each side edge of a nozzle plate includes a bevel.

The air conveyor 20 can be many different dimensions. In one example used for a tabbing machine such as a Linx™ tabbing machine or Rapid Spool Change™ (RSC) tabber sold by the assignee, Profold, Inc. of Sebastian, Fla., the air conveyor is typically about 5¾ inches wide by about 1½ inches wide and about 1½ inches in height (as non-limiting example dimensions). In one non-limiting example, each nozzle plate 42,44 includes eight (8) air nozzles 50 that are evenly spaced between the air slots 56 near opposing edges and typically about a half inch apart in a non-limiting example. It is found that the air slots 56 can be positioned about 5 inches apart in a non-limiting example. The air conveyor can be made from 6061-T6 aluminum material in a non-limiting example and does not require a finished surface.

FIG. 11 shows a tabbing machine 100 that includes the air conveyor 20 secured onto the tabber housing 102 near the underside of the housing. This tabbing machine 100 includes a conveyor 104 supported by the tabber housing 102 and configured to advance an article to be tabbed along a predetermined path of travel 105. A tab dispenser 106 is supported by the tabber housing 102 and positioned above the path of travel 108 and configured to dispense a tab from a web of material containing tabs and onto the article as it passes under the tab dispenser. An example tabbing machine is the Rapid Spool Change™ (RSC) tabber as manufactured by Profold, Inc. of Sebastian, Fla. As illustrated, it includes two tab spools 110 with simplified threading and a six-inch color touch screen 112 to provide an operator input for various instructions. Product size can vary from a minimum of 3×6 inches to about 9×12 inches and have a throughput of 30,000 pieces per hour as two tabs in one non-limiting example. This particular tabbing machine 100 has a pass-line height of about 34.5 to about 38.5 inches in a non-limiting example. The product thickness can vary for tabbing from about 5/16 inches and labeling of about 5/16 inches. Throughout this description, the term "tabbing" is considered synonymous to the term "labeling" for purposes of description such that material is applied from the web of material using the tabbing machine. Power is typically 115 VAC with a 10 amp-single phase supply. This RSC tabbing machine 100 provides greater production time between loading spools and simplifies the tabbing process and reduces operator interfacing and provides cost effective tabbing technology. It is possible to apply one to about eight tabs in one pass. It includes a twist-belt function and can provide the operator "continuous" tab placement and produces about 30,000 single tab pieces per hour. This tabbing machine 100 includes an in-feed, bump turn to run in line with folders, stickers and trimmers. Example modified tabbing machines that can be used include those disclosed in commonly assigned U.S. Pat. Nos. 5,393,366; 6,196,392; and 6,328,839, the disclosures which are hereby incorporated by reference in their entirety.

Many modifications and other embodiments of the invention will come to the mind of one skilled in the art having the benefit of the teachings presented in the foregoing descriptions and the associated drawings. Therefore, it is to be understood that the invention is not to be limited to the specific embodiments disclosed, and that the modifications and embodiments are intended to be included within the scope of the dependent claims.

That which is claimed is:

1. An apparatus for applying a tab onto an article, comprising, a tabber housing;

a conveyor supported by the tabber housing and configured to advance an article to be tabbed along a predetermined path of travel;

a tab dispenser supported by the tabber housing and positioned above the path of travel and configured to dispense a tab from a web of material containing tabs and onto the article as it passes under the tab dispenser; and an air conveyor supported by the tabber housing and configured to withdraw the web of material after tabbing, and further comprising a housing having an air chamber and a web entry, a web exit and air port communicating with the air chamber, and a nozzle assembly positioned within the air chamber and comprising upper and lower nozzle plates that extend across the air chamber and spaced from each other to form a web delivery channel that is aligned with the web entry and web exit, each of said nozzle plates further comprising a plurality of air nozzles extending through the nozzle plate and configured to pass pressurized air from the air chamber into the web delivery channel such that a web of material entering the web entry is drawn from the web entry through the web delivery channel and out of the web exit.

2. The apparatus according to claim 1, wherein the air nozzles are angled to extend through the nozzle plates in a direction from the web entry towards the web exit.

3. The apparatus according to claim 2, wherein each air nozzle is angled from about 5 degrees to about 25 degrees relative to a surface of the nozzle plate.

4. The apparatus according to claim 1, wherein each air nozzle has a diameter of between about 0.020 to about 0.040 inches.

5. The apparatus according to claim 4, wherein each air nozzle further comprises a counterbore extending at least partially therethrough.

6. The apparatus according to claim 1, wherein each nozzle plate has at least one air slot configured to allow pressurized air to pass through the nozzle assembly and pressurize the air chamber on both sides of the nozzle assembly.

7. The apparatus according to claim 6, further comprising a nozzle gap gasket positioned between each nozzle plate inward of the at least one air slot and configured to seal the nozzle assembly and prevent pressurized air within the air chamber from passing edgewise between the nozzle plates and into the web delivery channel.

8. The apparatus according to claim 1, wherein pressurized air between about 5 and 25 pounds per square inch is passed into the air chamber through the air port.

9. The apparatus according to claim 1, further comprising a venturi gasket positioned along both nozzle plates at each of the web entry and web exit and having an opening dimensioned to pass a web of predetermined size.

10. The apparatus according to claim 1, further comprising an air delivery tube mounted to the housing at the air port through which pressurized air is delivered and further comprising a clamp and arm mount attached to the air delivery tube and onto the tabber housing.

* * * * *